US009908740B2

(12) United States Patent
Lohia

(10) Patent No.: US 9,908,740 B2
(45) Date of Patent: Mar. 6, 2018

(54) DEVICE AND A METHOD FOR TRANSFERRING ADVANCING YARN DURING BOBBIN CHANGEOVER IN AN AUTOMATIC TURRET TYPE YARN WINDER

(71) Applicant: Amit Kumar Lohia, Kanpur (IN)

(72) Inventor: Amit Kumar Lohia, Kanpur (IN)

( * ) Notice: Subject to any disclaimer, the term of this patent is extended or adjusted under 35 U.S.C. 154(b) by 0 days.

(21) Appl. No.: 15/115,907

(22) PCT Filed: Feb. 2, 2015

(86) PCT No.: PCT/IB2015/050776
§ 371 (c)(1),
(2) Date: Aug. 2, 2016

(87) PCT Pub. No.: WO2015/114598
PCT Pub. Date: Aug. 6, 2015

(65) Prior Publication Data

US 2017/0166414 A1 Jun. 15, 2017

(30) Foreign Application Priority Data

Feb. 3, 2014 (IN) ..... 3253/DEL/2013

(51) Int. Cl.
*B65H 67/048* (2006.01)
*B65H 54/28* (2006.01)
(Continued)

(52) U.S. Cl.
CPC ..... *B65H 67/048* (2013.01); *B65H 54/2812* (2013.01); *D01H 9/001* (2013.01); *D01H 9/02* (2013.01); *B65H 2701/31* (2013.01)

(58) Field of Classification Search
CPC ..... B65H 67/048; B65H 54/2809; B65H 54/2812; D01H 9/02; D01H 9/001
See application file for complete search history.

(56) References Cited

U.S. PATENT DOCUMENTS 3,921,923 A * 11/1975 Kuno ..... B65H 54/2893 242/474.6
4,084,760 A 4/1978 Nakano et al.

FOREIGN PATENT DOCUMENTS

EP 1507730 A1 2/2005
WO WO-03099695 A1 * 12/2003 ..... B65H 54/2812

OTHER PUBLICATIONS

Machine Translation of WO 03/09965 A1, Dec. 4, 2003.*
(Continued)

*Primary Examiner* — William E Dondero

(57) ABSTRACT

The present invention is a part of a yarn transfer system used for transferring yarn from a full bobbin to an empty bobbin typically fitted on a winder frame. The invention broadly comprises a yarn traverse device used in transferring a continuously arriving yarn onto an empty bobbin for commencing of winding process during bobbin changeover process in automatic turret winder without any stoppage. This is achieved with the provision of an actuation device that facilitates axial movement of the yarn traverse device. In the present invention, during the bobbin changeover operation, the yarn traverse device is moved axially through the actuation device and allows the traverse guide—while maintaining its normal traverse speed at all times—to move beyond the normal yarn winding zone such that the advancing yarn is within the reach of the yarn grasping device of the ready-to-be-wound empty bobbin. After the yarn transfer is completed, the traverse device moves back to the normal winding zone.

18 Claims, 5 Drawing Sheets

(51) Int. Cl.
*D01H 9/02* (2006.01)
*D01H 9/00* (2006.01)

(56) References Cited

OTHER PUBLICATIONS

Written Opinion for PCT/IB2015/050776 dated Jun. 1, 2015.
International search Report for PCT/IB2015/050776 dated Jun. 1, 2015.
International Preliminary Report on Patentability for PCT/IB2015/050776 dated May 11, 2016.

* cited by examiner

DEVICE AND A METHOD FOR TRANSFERRING ADVANCING YARN DURING BOBBIN CHANGEOVER IN AN AUTOMATIC TURRET TYPE YARN WINDER

FIELD OF THE INVENTION

The present invention relates to automatic turret type winders and more particularly to devices used in transferring of continuous advancing yarn onto empty bobbins during bobbin changeover operations.

BACKGROUND OF THE INVENTION

In the following description, the term "yarn" is intended to include the threads, tapes, profile tapes, fibrillated tapes and slit-film bands of various linear mass density, diameter, width and thickness. The term 'yarn' is also used to describe yarn with multiple threads or ends that a single winder might receive. The term "bobbin" is intended to include any metallic or non-metallic tubes on which the yarn is wound to form a suitable package.

Automatic turret type winders are used in production or take-up process of continuously advancing yarn, for example, in yarn extrusion machines or in rewinding process for making plurality of small size yarn packages from a large yarn package. In general, the turret type automatic winders are positioned side by side in the horizontal direction and stack one above the other in vertical direction. The number of winding positions is exemplary both in horizontal row and vertical row.

The yarn transfer operation is important in the automatic yarn winding operation. If the yarn is not transferred in the first attempt, the continuously advancing yarn gets wasted until it is rethreaded. Worse still, the continuously advancing yarn, if not controlled properly in case it fails to transfer onto the empty bobbin, may interfere with the other yarn winders on the same machine and cause the entire machinery to stop which results in a huge amount of wastage, machine down-time and economic loss. In the worst situations, some parts of the machinery may get damaged.

In automatic turret type winders, a continuously advancing yarn is generally wound on an initially empty bobbin to form a suitable yarn package. When the pre-determined package size (length/diameter/time) is achieved on a bobbin installed on one of the bobbin holders, generally known as a spindle, the continuously advancing yarn is transferred to an empty bobbin installed on another spindle to make a new yarn package. The yarn transfer is carried out by an automatic transfer device and without interrupting the winding operation.

Some of the known devices for transferring the yarn to the grasping device, such as the one disclosed in EP 03725171, involve complex mechanisms. The yarn transfer is achieved by a movement of the entire swivel box that houses the traversing mechanism. This type of movement, which involves the axial displacement of a large mass, requires a complex and expensive device for its execution. Another device, disclosed in the U.S. Pat. No. 8,267,342, uses a mechanical system with special traverse guide mechanism of introducing advancing yarn into a grasping device during the bobbin changeover operation in automatic winder. However, there are a few drawbacks in this system: precision required in the setting of links and limitation in separating yarn from traverse guide and precise, consistency required in re-insertion of yarn back into traverse guide.

One key drawback of prior art systems where the winding operation needs stopping of traverse device during the changeover process is that it reduces the speed and efficiency of the winding operation. The conventional systems that allow yarn transfer without the stoppage of the winding operation are bulky and complex.

There is therefore a need to provide a simple mechanism of achieving the yarn transfer to the catchment area of an empty bobbin followed by returning the yarn to the winding area without stopping the traverse device.

OBJECTS AND ADVANTAGES OF THE INVENTION

The present invention provides a simple mechanism to achieve the movement of the yarn to the catchment area and to return yarn back into the traverse area without any stoppage of the traverse device.

Accordingly, one object of the invention is to provide a device to shift the advancing yarn from the bobbin traverse area onto to catchment area (or grasping area) of the spindle of an empty bobbin.

A further object of the present invention is to provide a device to return the advancing yarn, from catchment area onto yarn traverse area.

Another object of the present invention is to enable shifting of yarn from the traverse area to the catchment area without separation of yarn from traverse guide.

A further object of the present invention is to allow the yarn shifting from the traverse area to the catchment area without stopping the traverse guide movement.

SUMMARY OF INVENTION

The present invention is a part of a yarn transfer system used for transferring yarn from a full bobbin to an empty bobbin typically fitted on a winder frame. The invention broadly comprises a yarn traverse device used in transferring a continuously arriving yarn onto an empty bobbin for commencing of winding process during bobbin changeover process in automatic turret winder without any stoppage. This is achieved with the provision of an actuation device that facilitates axial movement of the yarn traverse device. In the present invention, during the bobbin changeover operation, the yarn traverse device is moved axially through the actuation device and allows the traverse guide—while maintaining its normal traverse speed at all times—to move beyond the normal yarn winding zone such that the advancing yarn is within the reach of the yarn grasping device of the ready-to-be-wound empty bobbin. After the yarn transfer is completed, the traverse device moves back to the normal winding zone.

LIST OF PARTS

Yarn transfer device or system - 1
Winder frame - 1A
Traverse device - 2
Arriving yarn - 3
Empty Bobbin - 4
Actuating (or actuation) device - 5
Winding zone (yarn traverse area) - 6
Traverse guide - 7
Turret - 8
Winding bobbin - 9
Cam box - 10

-continued

| |
|---|
| Cross spiraled shaft - 11 |
| Grooves - 11A |
| Drive means - 12 |
| Traverse housing - 13 |
| Pressure (or contact) roller - 13A |
| Grasping device - 14 |
| Straight guide slot - 15 |
| Catchment area - 16 |
| Double actuating cylinder - 17 |
| Actuating piston rod - 18 |
| First pressure chamber - 19 |
| Second pressure chamber - 20 |
| First inlet - 21 |
| Second inlet - 22 |
| Piston head - 23 |

DESCRIPTION OF THE INVENTION

Figure 1:
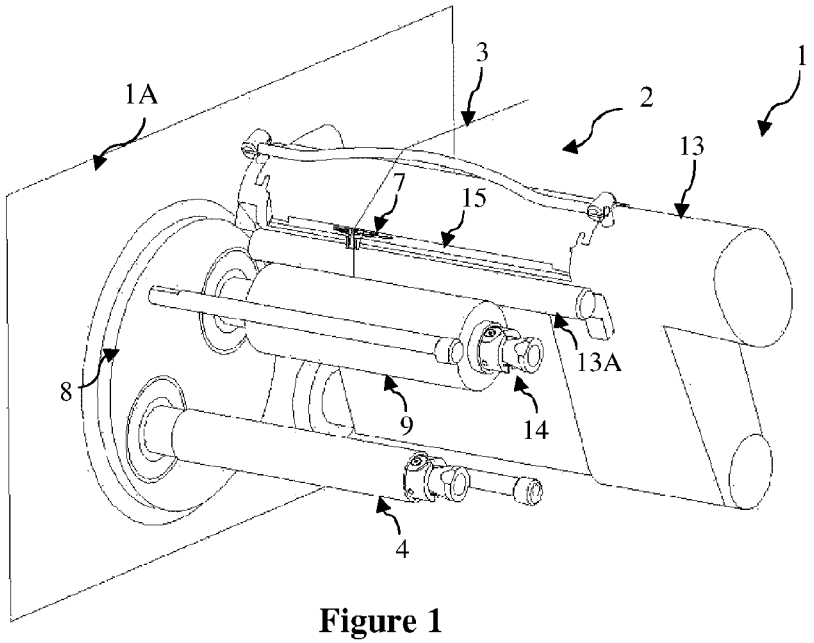
FIG. 1 shows the perspective view of the device of the invention during the yarn winding mode

The present invention is a part of a yarn transfer system (1) used for transferring yarn from a full bobbin to an empty bobbin typically fitted on a winder frame (1A). The invention broadly comprises a yarn traversing device (2) (also termed as a yarn traverse device or simply a traverse device) used in transferring a continuously arriving yarn (or simply yarn) (3) onto an empty bobbin (4) for commencing of winding process during bobbin changeover process in automatic turret winder without any stoppage. This is achieved with the provision of an actuation device (5) that facilitates axial movement of the yarn traverse device (2).

The conventional automated turret type yarn winders have a traverse mechanism for laying yarn along the length of spindle on which the yarn gets wound, generally with help of a traverse guide. They also have a system with which the spindles shift into and away from winding positions, and rotate during the winding operation, and a system to transfer yarn onto an empty bobbin during changeover from full bobbin to the empty bobbin. In winder systems, the traverse mechanism lays yarn linearly onto the bobbin throughout the normal running conditions, which represents the winding operation. During the bobbin-changeover stage, the traverse guide (7), which is a part of the traverse device (2), typically positions itself at the end of its own movement span and helps the advancing yarn (3) to get grasped into a grasping device (14) of an empty bobbin (4). The traverse mechanisms would be selected from cross spiral shaft type mechanisms, or a groove drum or stepper motor-belt type mechanisms, or other known mechanisms depending on requirement.

All conventional yarn transfer systems require the traverse guide to come to a momentary standstill at the time of bobbin changeover.

The present invention, however, provides an improved turret type automated yarn winder, wherein provided is a yarn traversing device (2) which incorporates an actuation device (5), in aiding transfer of the arriving yarn (3) onto an empty bobbin (4) during a bobbin changeover process without requiring the traverse guide (7) to come to a halt. The traverse guide (7) thus operates at its normal operating speed at all times. The normal operating speed of the traverse guide (7) is controlled by an electronic control device not shown in figures. The yarn transfer system (1) is adapted to be compatible with depending on the traverse device (2) employed.

In the present invention, during the bobbin changeover operation, the yarn traverse device (2) is moved axially through an actuation device (5) and allows the traverse guide (7)—while maintaining its normal traverse speed—to move beyond the normal yarn winding zone (6) such that the advancing yarn (3) is within the reach of the yarn grasping device (14) of the ready-to-be-wound empty bobbin (4). Regardless of the type of traverse mechanism employed, the yarn transfer device (1) of the invention allows the axial movement.

The yarn transfer system along with the present invention is now illustrated. FIG. 1 shows a first bobbin being wound with a continuously yarn in an automatic turret type winding machine. It shows a turret (8) with an empty bobbin (4) which would be brought to winding position once the winding bobbin (9) is wound with yarn to desired size. It further shows a cam box (10) which houses part of a yarn traverse device (2) of the invention. The traverse device (2) illustrated here consists of a rotatable cross-spiral shaft (11) which is housed inside the cam box (10), a traverse guide (7) suitably engaged with the cross-spiral shaft (11) which moves in forward and reverse (or backward) directions and facilitates the traversing of the traverse guide (7), and a drive means (12) for imparting rotational motion to the cross-spiral shaft (11). The cross spiral shaft (11) is mounted inside the cam box (10) using at least one bearing (not shown in figures). Further, the actuation device (5) imparts axial movement to the traverse device (2) as a whole.

The actuation device (5) is powered by various modes of energy such as pneumatic or hydraulic pressure, electricity or their combination. A traverse housing (13) encloses the traverse device (2), actuation device (5), and some other standard operating assemblies used in the yarn winder.

Figure 7A:
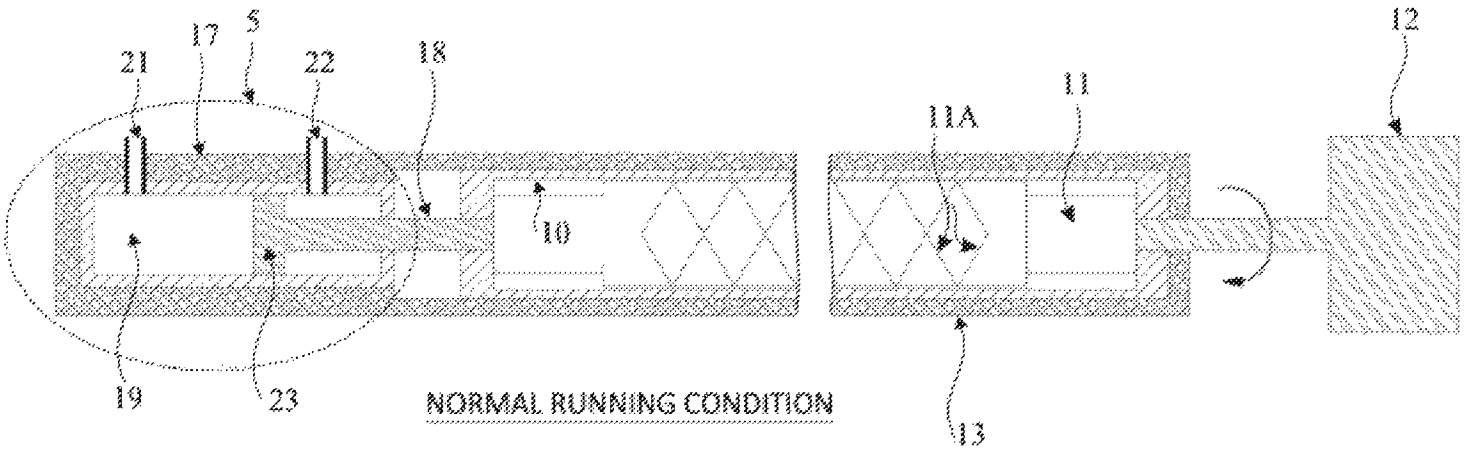
FIG. 7A shows the working of the actuation device in normal working conditions
Figure 7B:
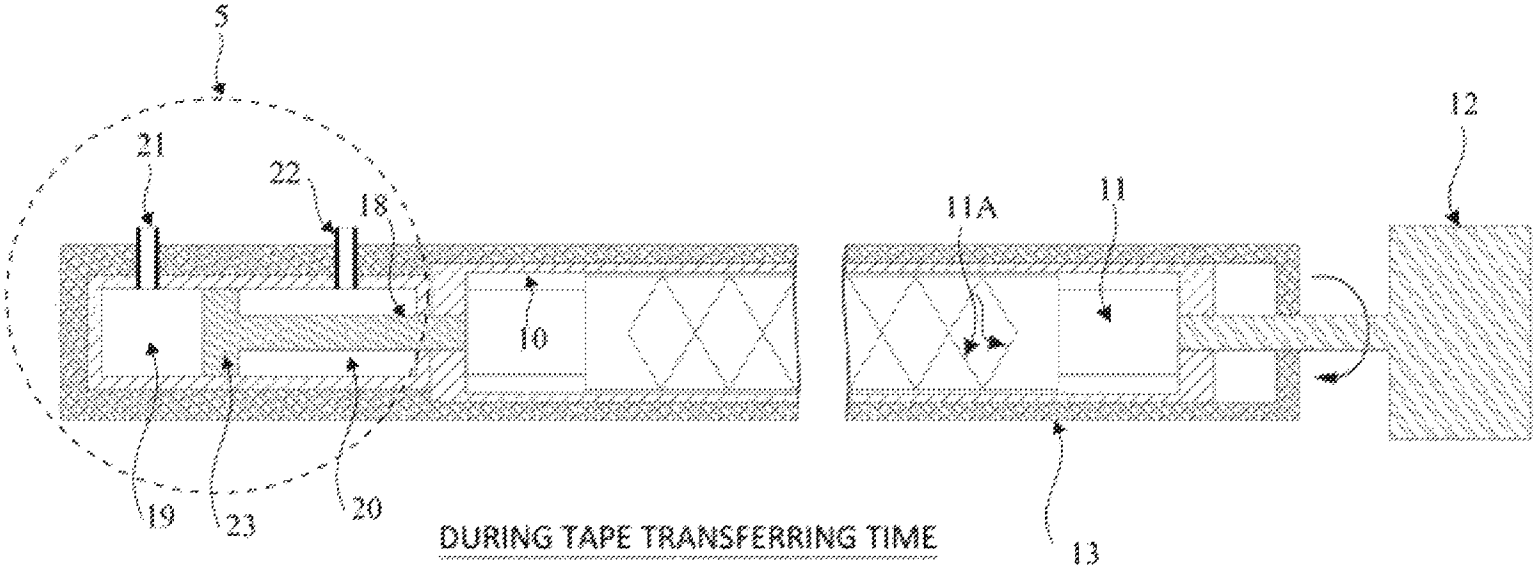
FIG. 7B shows the working of the actuation device during the yarn transfer stage of the bobbin changeover operation

The cross-spiraled shaft (11) (as shown in FIGS. 7A and 7B) forms a part of the traverse device (2). Referring to FIG. 1 once again, a traverse guide (7) reciprocates in grooves (11A) of the cross-spiraled shaft and is guided back and forth in a straight guide slot (15) formed in a guide plate provided on the cam box (10). The traverse guide (7) directs the arriving yarn (3) onto a yarn winding bobbin tube to form a cross-wound package. The two opposite end portions of the bobbin tube are substantially free of yarn windings.

It is important to note that the during normal yarn winding (yarn-laying) in the conventional yarn winding apparatuses, the traverse guide (7) traverses within the zone termed as the winding zone (6). During the winding operation, it is important that the traverse guide (7) does not travel beyond the limits of the winding zone (6) as otherwise it will destroy the consistency of winding of the arriving yarn (3) over the winding bobbin (9) and the finished package will be of non-uniform thickness over its winding zone (6).

Figure 2:
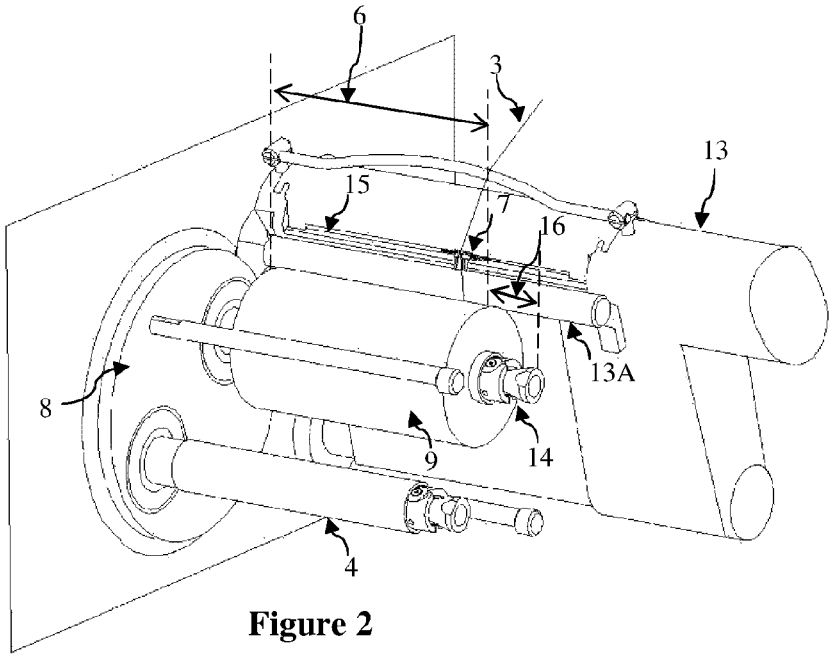
FIG. 2 shows the perspective view of the device of the invention during the yarn winding mode when a bobbin is fully wound

At the same time, once the winding operation is complete, the arriving yarn (3) needs to be transferred to an empty bobbin (4). To achieve this, the arriving yarn (3) needs to be positioned near the yarn grasping devise (14) of the empty bobbin (4). For this purpose, the traverse guide (7) needs to move out of the winding zone (6) and into the zone or area termed as the catchment area (16) (indicated in FIG. 2). The catchment area (16) is the area where the traversing guide (7) has to be positioned so that the arriving yarn (3) overlaps the grasping device (14). In this position, and under its own tension, the advancing yarn (3) comes in contact with the yarn grasping device (14) of the empty bobbin (4) and gets grasped so that it can be wound on the empty bobbin (4). As a key advantage, the present invention facilitates yarn transfer during bobbin changeover without reducing the speed of the traverse guide (7) from its normal operating speed.

The bobbin tube is driven by and supported on a winding spindle (driving of spindle has not been shown in the figures). During the winding operation, an empty bobbin (4), which constitutes a second winding spindle with an empty tube supported thereon, is provided in a standby position (see FIG. 1).

Figure 3:
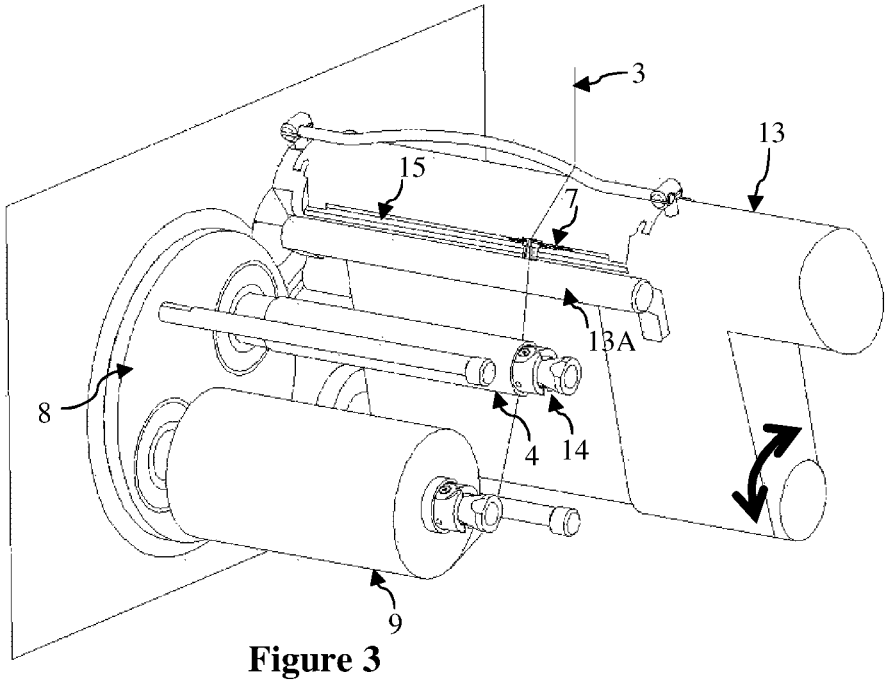
FIG. 3 shows the perspective view of the device when a bobbin is fully wound and the yarn traverse housing is moved away from the full bobbin
Figure 4:
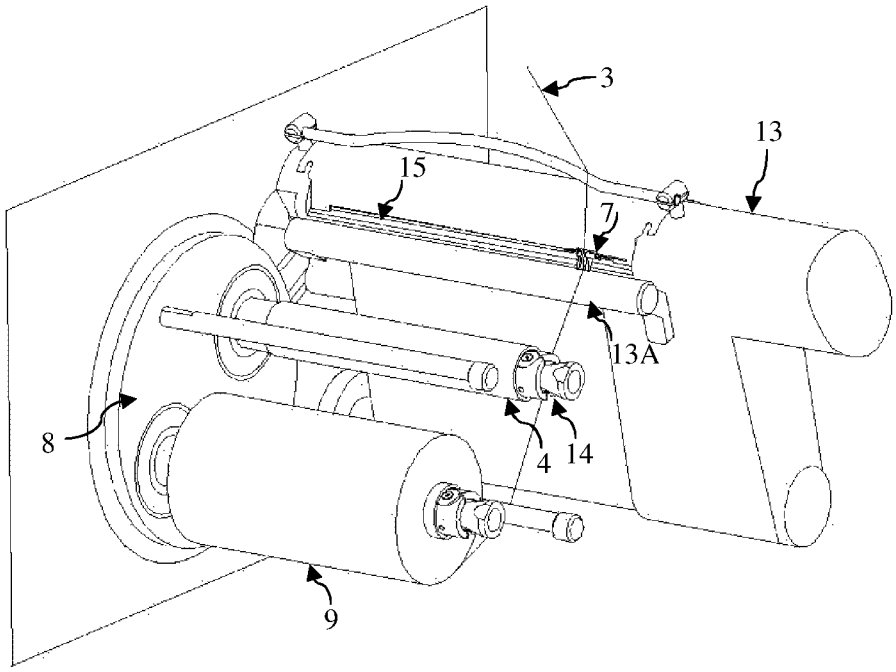
FIG. 4 shows the perspective view of the device of the invention with an empty bobbin in a winding position and the full bobbin moved away
Figure 5:
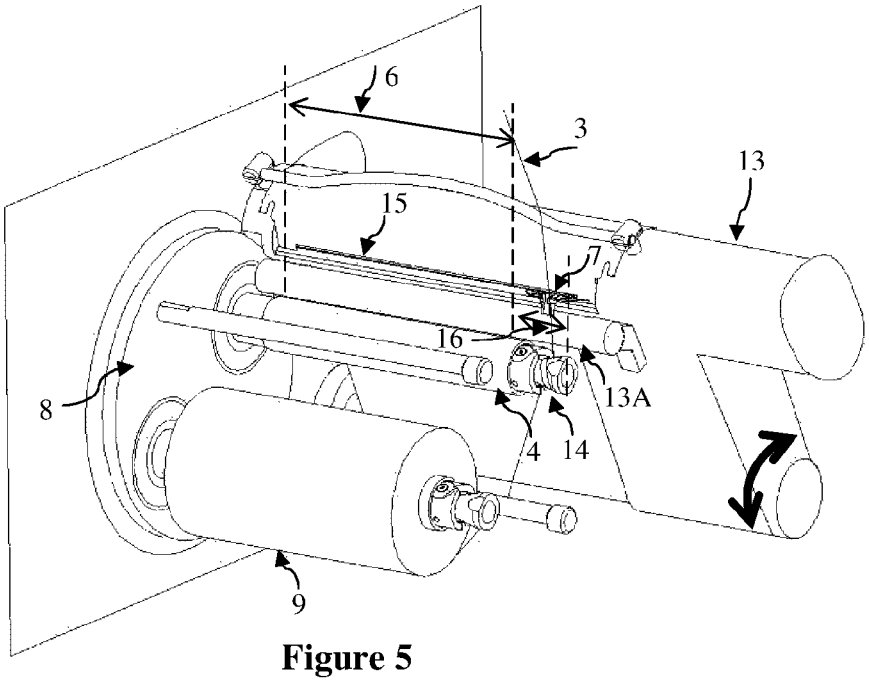
FIG. 5 shows the perspective view of the device of the invention with the yarn caught in the yarn grasp device of the empty bobbin

When the pre-determine size (length/weight/time) of package is achieved (see FIG. 2) or when there is manual intervention for bobbin changeover, the traverse housing (13) moves away from the winding spindle in a swivel action (see the movement arrow shown in FIG. 3), and concurrently the empty bobbin (4) (movement not shown in figures) is driven by a drive and moved into the plane of advancing yarn (3) to an active or winding position (see FIG. 4). For this purpose, the two winding spindles are supported on the turret (8) which is rotatable about an axis perpendicular to the plane of the turret (8). Following this, the traverse housing (13) moves back in a swivel action close to the empty bobbin (4) situating itself ready for the winding operation (see FIG. 5).

Further, without stopping the normal movement of the traverse guide (7), the cam box (10), and consequently the cross-spiraled shaft (11) of the yarn traversing device (2), is internally (i.e. completely inside the traverse housing (13)) axially shifted by the actuation device (5) such that the arriving yarn's (3) 'transfer point' (a point from where the arriving yarn (3) is transferred by the traverse guide (7) to the grasping device (14)) is positioned within the catchment area (16) (also termed as the grasping area). This is seen from FIGS. 5 and 7B.

Figure 6:
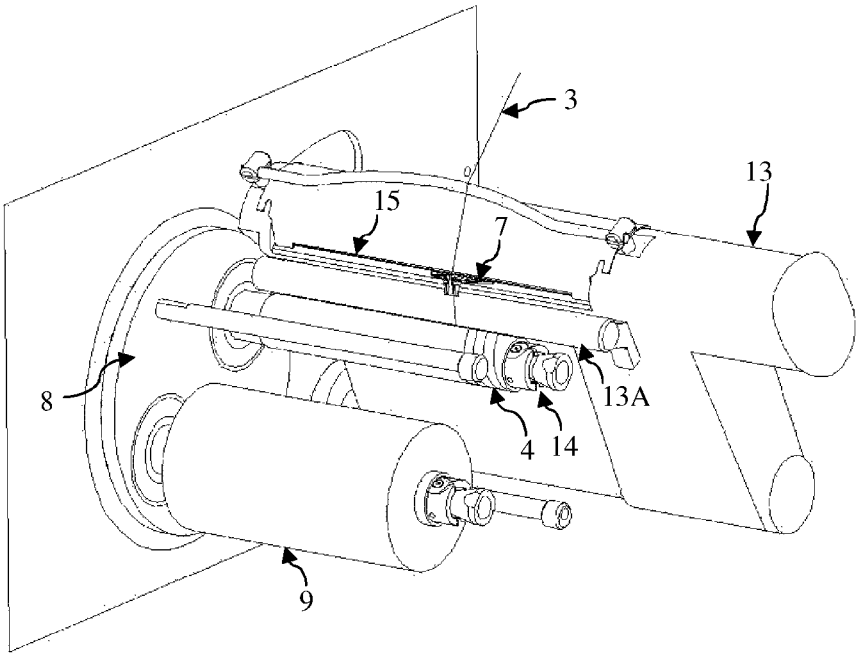
FIG. 6 shows the perspective view of the device of the present invention with the empty bobbin in the yarn winding mode

During the bobbin changeover operation, the turret (8) would rotate around its axis, with or without any swivel (or backward) movement of the traverse housing (13). Then, as soon as the spindle of the empty bobbin (4) is placed at the winding position, the cross-spiraled shaft (11) of the traverse device (2) is pneumatically shifted in forward axial direction (See FIGS. 5 and 7A) such that the arriving yarn (3) comes onto the catchment area (16). With the rotation of spindle, and under the effect of the inherent tension in the arriving yarn (3), the yarn grasping device (14) mounted on the spindle of the empty bobbin (4) catches the arriving yarn (3) in its grasping element (not shown in figures) and the arriving yarn (3) gets severed from the winding bobbin (9) mounted on other spindle. Simultaneously with the severance of the arriving yarn (3), the cross-spiral shaft (11) is pneumatically (or by any other means) retracted back axially (reverse axial movement) to normal traverse zone or winding zone (6) of the empty bobbin (4), and normal winding of continuously arriving yarn (3) resumes (see FIG. 6).

The internal axial shifting of traverse device (2) is achieved using the actuation device (5). The working of the actuation device (5) is shown in FIGS. 7A and 7B. In the present embodiment, the actuation device (5) comprises a double acting actuating cylinder (17), an axially movable actuating piston rod (18), and a first pressure chamber (19) and a second pressure chamber (20) that are formed on either side of the piston rod (18). One end of the piston rod (18) is fixedly attached to the end of the cam-box (10). The actuation device (5) operates its various components using actuating fluid (not shown in figures) which is introduced to and removed from the actuating cylinder (17) as necessary. The actuating cylinder (17), which converts the energy of the compressed air into linear motion, is of a double acting type. The actuating cylinder (17) has two apertures or inlets (namely, a first inlet (21) and a second inlet (22)) through which the fluid that powers the action of the actuating cylinder (17) enters the pressure chambers (19 and 20) and exits therefrom. Both inlets (21, 22) alternately act as intake and exhaust depending on the position of the piston head (23).

The invention thus ensures that the cam box (10) moves or slides axially forward and backward completely inside the traverse housing (13).

Inside the dual acting actuating cylinder (17), the first pressure chamber (19) and the second pressure chamber (20) are formed on either side of the piston rod (18) (see FIGS. 7A and 7B). Depending on the stroke movement of the traverse device (2), each of the pressure chambers (19, 20) is alternatively subjected to a pressure build-up and a pressure relief with the help of the supply of compressed air which is governed by suitable control means. The order in which the pressure build-up and relief is applied depends on the stroke—the order during the forward and reverse axial movements being opposite to each other. During the normal running condition, the piston head (23) remains at the near end of the dual acting cylinder (17), being defined as the end near the turret plate (8). During the yarn transfer time, the piston rod (18) is moved in a forward direction, defined as the movement away from the turret plate (8).

To facilitate the forward movement of the piston rod (18), the second inlet (22) acts as an air intake (or a fluid intake as fluid of any type in general may be used) leading to a pressure build-up in the second pressure chamber (20), and a simultaneous pressure relief in the first pressure chamber (19). The simultaneous pressure relief and pressure build-up pushes the piston rod (18) in the forward direction. Once the yarn transfer operation is complete, the piston rod (18) moves back in a direction towards the turret plate (8). To facilitate this, the first inlet (21) now acts as a fluid intake and the second inlet (22) as the exhaust port, leading to a pressure build-up in the first pressure chamber (19), and a simultaneous pressure relief in the second pressure chamber (20). The piston rod (18) thus returns to its normal running condition position. The actuating piston rod (18) is thus reciprocally moved by alternatively supplying air (or any suitable fluid) into the pressure chambers (19, 20) formed on either side of the piston rod (18).

An electro-mechanical control system may be used to govern the activation of actuation device base on signal from controller.

The actuation device (5) may be located non-axially with the cam box (10), or the cross-spiraled shaft (11), or traverse device (2) as a whole. In this case, the actuation force (the force required to cause the axial movement of the cross-spiraled shaft (11) or the cam box (10)) is transferred to the cross-spiraled shaft (11) using a link mechanism.

In another embodiment, the axial movement of said traverse device (2) is facilitated using a hydraulic system, or a magnetic solenoid type actuator with a return spring, or a rack-pinion system and an electric motor. In the case of any axial movement facilitated by fluids, the movement is aided by the pressure build-up and relief as explained earlier. There are other alternative mechanisms, such as magnetic solenoid based system or mechanical systems involving return springs or rack or pinions, or electric systems, to effect linear axial movement of the traverse device (2). In these alternative mechanisms, there's no need for a double acting actuating cylinder (17).

In the present inventive method, as there is only axial shifting of traverse guide (7) out of the winding zone (i.e. the zone covered by the yarn during traversing), the advancing yarn (3) remains intact and engaged in the traverse guide (7) of any given design during the bobbin changeover operation. Further, as the yarn transfer method involves only fluid pressure, there are no complicated mechanical linkages or parts involved and the response is quick, accurate and consistent.

Thus, with present inventive method and device, the bobbin changeover with advancing yarn (3) is achieved without stoppage of the movement of the traversing guide (7) and also by keeping the advancing yarn (3) intact and engaged, at all times, with the yarn traverse guide (7).

The swivel movement of the traverse housing (13) during the yarn transfer process is viewed as an additional and undesirable step—it not only adds to the time of bobbin changeover operation but it also undesirably affects the consistency of the winding (particularly in the context of yarn tension).

In another embodiment of the invention, the swivel movement of the traverse housing (13) at the time of the bobbin changeover is eliminated, in the case where the package diameter is equal to or greater than a pre-decided value. The swivel action is generally necessitated by the fact that a pressure roller (13A) (also termed as contact roller; not shown in figures) and the traverse housing (13), which lean on the winding bobbin (9), obstruct the rotational movement of the turret (8) which is required to bring the empty bobbin (4) into the winding position. Then, as soon as the empty bobbin (4) spindle is placed at winding position, the cross-spiral shaft (11) is pneumatically shifted in axial direction such that the advancing yarn (3) comes onto the catchment area (16). With the rotation of spindle the yarn grasping device (14) mounted on spindle would catch the yarn (13) in its grasping element and the yarn (3) gets severed from the winding bobbin (9) mounted on other spindle. Simultaneously, the cross-spiral shaft (11) is retracted back to normal traverse zone, pneumatically, and normal winding of continuously arriving yarn (3) takes place.

In another embodiment, the entire axial movement of the cam box (10) occurs inside the traverse housing (13).

Based on the foregoing discussion, it is evident that the invention has the following embodiments:

1. A device (1) for transferring advancing yarn during bobbin changeover in an automatic turret type yarn winder incorporating a winder frame (1A), a rotatable turret (8) on which plurality of rotatable spindles for holding bobbins (4 and 9) are mounted, means for rotating said turret (8) to alternate exchange positions of said bobbins (4 and 9) between a winding position and stand-by position, and a traverse housing (13) characterized in that said yarn transfer device (1) comprises a traverse device (2) for traversing at least one advancing yarn (3) into the yarn traverse area (6) of the winding bobbin (9) and an actuation device (5) capable of generating axial forward and reverse movements of said traverse device (2) internally inside said traverse housing (13), during yarn transfer in bobbin changeover operation, wherein said actuation device (5) is positioned inside said traverse housing (13); wherein said traverse device (2) comprises a rotatable cross-spiral shaft (11) mounted inside a cam box (10) with the help of at least one bearing, said cam box (10) enclosed within said traverse housing (13), a traverse guide (7) engaged with cross-spiral shaft (11), a drive means (12) for imparting rotational motion to said cross-spiral shaft (11), said drive means (12) axially positioned with respect to and directly connected with said cross-spiraled shaft (11), and wherein said traverse guide (7) traverses continuously at its normal traversing speed without coming to a complete halt during the yarn transfer or bobbin changeover operation.
2. A device (1) for yarn transfer as disclosed in embodiment 1, characterized in that the said actuation device (5) operates pneumatically or hydraulically, or in an electrically motorized mode or in a combination of thereof.
3. A device (1) for yarn transfer as disclosed in embodiments 1 to 2, characterized in that the one or more ends of advancing yarn (3) remain intact and engaged with traverse guide (7) during the yarn transfer operation at the time of bobbin changeover from the full to an empty bobbin.
4. A device (1) for yarn transfer as disclosed in embodiments 1 to 3, characterized in that a yarn grasping device (14) is provided in the form of a grasping element mounted on the spindle or in the form of grooves provided on the bobbin.
5. A device (1) for yarn transfer as disclosed in embodiments 1 to 4, characterized in that a contact roller (13A) is optionally mounted on said traverse housing (13).
6. A device (1) for yarn transfer as disclosed in embodiments 1 to 5, characterized in that a swivel movement of traverse housing (13) during bobbin changeover from full to empty bobbin takes place in the case where the diameter of the winding bobbin (9) is less than the predetermined diameter of the bobbin at the winding position.
7. A device (1) for yarn transfer as disclosed in embodiments 1 to 6, characterized in that the actuation means (5) or device comprises a double acting actuating cylinder (17), an axially movable actuating piston rod (18), and a first fluid inlet (21) and a second fluid inlet (22), and inside said cylinder (17), a first pressure chamber (19) and a second pressure chamber (20), said first pressure chamber (19) being formed on one side of the piston head (23) and said second pressure chamber (20) being formed towards the turret end of the piston rod (18), with said first fluid inlet (21) opening into said first pressure chamber (19) and second fluid inlet (22) opening into said second pressure chamber (20), said piston rod (18) being fixedly attached to said cam box (10), and the said actuating piston rod (18) axially reciprocally moves with its forward movement being caused by the pressure build-up in said second pressure chamber (20) and a simultaneous pressure relief in said first pressure chamber (19), and its reverse movement being caused by the pressure build-up in said first pressure chamber (19) and a simultaneous pressure relief in said second pressure chamber (20), said pressure build-ups and reliefs being caused by the fluids.

8. A device (1) for yarn transfer as disclosed in embodiments 1 to 7, further wherein an electro-mechanical control system is used to govern the activation of actuation device (5) base on signal from controller.
9. A device for yarn transfer as disclosed in embodiments 1 to 8, wherein said actuation device (5) is positioned non-axially with said cross spiraled shaft (11), and the actuation force is transmitted to said cross spiraled shaft (11) using a link mechanism.
10. A device for yarn transfer as disclosed in embodiments 1 to 9, wherein the cam box (10) moves axially forward and backward entirely inside said traverse housing (13).
11. A method for yarn transfer during bobbin changeover operation in automatic turret type winder, said method comprising the steps of:
    a. initiating yarn transfer operation in that the attainment of desired size bobbin or manual intervention
    b. optionally moving traverse housing (13) in a swivel action away from winding bobbin (9)
    c. rotating the turret (8) of said winder and placing said empty bobbin (4) in winding position
    d. placing traverse housing (13) in a position to allow yarn transfer
    e. axially shifting the traverse device (2) of claims 1 to 11 to extend the movement of traverse guide (7) beyond winding zone (6) up to yarn catchment area (16) of said empty bobbin
    f. allowing the movement of continuously arriving yarn (3) such that it is placed into yarn grasping device (14) of said empty bobbin (4)
    g. axially retracting the traverse device (2) back to winding zone (6)
    h. commencing of normal yarn laying or winding on empty bobbin (4).
12. A method as disclosed in embodiment 11, characterized in that the axial movement of said traverse device (2) is facilitated by the pneumatic or hydraulic or electrical energy.

While the above description contains much specificity, these should not be construed as limitation in the scope of the invention, but rather as an exemplification of the preferred embodiments thereof. It must be realized that modifications and variations are possible based on the disclosure given above without departing from the spirit and scope of the invention. Accordingly, the scope of the invention should be determined not by the embodiments illustrated, but by the appended claims and their legal equivalents.

The invention claimed is:

1. A device (1) for transferring advancing yarn during bobbin changeover in an automatic turret type yarn winder incorporating a winder frame (1A), a rotatable turret (8) on which a plurality of rotatable spindles for holding bobbins (4 and 9) are mounted, means for rotating said turret (8) to alternate exchange positions of said bobbins (4 and 9) between a winding position and a stand-by position, and a traverse housing (13) characterized in that said yarn transfer device (1) comprises a traverse device (2) for traversing at least one advancing yarn (3) into the yarn traverse area (6) of the winding bobbin (9) and an actuation device (5) capable of generating axial forward and reverse movements of said traverse device (2) internally inside said traverse housing (13), during yarn transfer in bobbin changeover operation, wherein said actuation device (5) is positioned inside said traverse housing (13); wherein said traverse device (2) comprises a rotatable cross-spiral shaft (11) mounted inside a cam box (10), said cam box (10) enclosed within said traverse housing (13), a traverse guide (7) engaged with said cross-spiral shaft (11), a drive means (12) for imparting rotational motion to said cross-spiral shaft (11), said drive means (12) axially positioned with respect to and directly connected with said cross-spiral shaft (11), and wherein said traverse guide (7) traverses continuously at its normal traversing speed without coming to a complete halt during the yarn transfer or bobbin changeover operation.

2. The device (1) for yarn transfer as claimed in claim 1, characterized in that the one or more ends of advancing yarn (3) remain intact and engaged with said traverse guide (7) during the yarn transfer operation at the time of bobbin changeover from the full to an empty bobbin.

3. The device (1) for yarn transfer as claimed in claim 2, further comprising a yarn grasping device (14).

4. The device (1) for yarn transfer as claimed in claim 3, further comprising a contact roller (13A).

5. The device (1) for yarn transfer as claimed in claim 4, characterized in that a swivel movement of traverse housing (13) during bobbin changeover from full to empty bobbin takes place in the case where the diameter of the winding bobbin (9) is less than a predetermined diameter of the bobbin at the winding position.

6. The device (1) for yarn transfer as claimed in claim 5, characterized in that the actuation means (5) or device comprises a double acting actuating cylinder (17), an axially movable actuating piston rod (18), and a first fluid inlet (21) and a second fluid inlet (22), and inside said cylinder (17), a first pressure chamber (19) and a second pressure chamber (20), said first pressure chamber (19) being formed on one side of the piston head (23) and said second pressure chamber (20) being formed towards the turret end of the piston rod (18), with said first fluid inlet (21) opening into said first pressure chamber (19) and second fluid inlet (22) opening into said second pressure chamber (20), said piston rod (18) being fixedly attached to said cam box (10), and the said actuating piston rod (18) axially reciprocally moves with its forward movement being caused by the pressure build-up in said second pressure chamber (20) and a simultaneous pressure relief in said first pressure chamber (19), and its reverse movement being caused by the pressure build-up in said first pressure chamber (19) and a simultaneous pressure relief in said second pressure chamber (20), said pressure build-ups and reliefs being caused by the fluids.

7. The device for yarn transfer as claimed in claim 6, wherein said actuation device (5) is positioned non-axially with said cross cross-spiral shaft (11).

8. The device for yarn transfer as claimed in claim 7, wherein the cam box (10) moves axially forward and backward entirely inside said traverse housing (13).

9. The device (1) for yarn transfer as claimed in claim 4, wherein the contact roller (13A) is mounted on said traverse housing (13).

10. A method for yarn transfer during bobbin changeover operation in a device of claim 1 having an automatic turret type winder, said method comprising the steps of:
    a. initiating yarn transfer operation in the device;
    b. rotating the turret (8) of said winder and placing an empty bobbin (4) in said winding position;
    c. placing traverse housing (13) in a position to allow yarn transfer;

d. axially shifting the traverse device (2) to extend the movement of traverse guide (7) beyond said winding zone (6) up to a yarn catchment area (16) of said empty bobbin;

e. allowing the movement of continuously arriving yarn (3) such that it is placed into a yarn grasping device (14) of said empty bobbin (4);

f. axially retracting the traverse device (2) back to said winding zone (6) commencing of normal yarn laying or winding on said empty bobbin (4).

11. The method of claim 10, further comprising moving the traverse housing (13) in a swivel action away from said winding bobbin (9) prior to performing step b.

12. A method for yarn transfer during bobbin changeover operation in a device of claim 2 having an automatic turret type winder, said method comprising the steps of:

a. initiating yarn transfer operation in the device;

b. rotating the turret (8) of said winder and placing said empty bobbin (4) in said winding position;

c. placing traverse housing (13) in a position to allow yarn transfer;

d. axially shifting the traverse device (2) to extend the movement of traverse guide (7) beyond said winding zone (6) up to a yarn catchment area (16) of said empty bobbin;

e. allowing the movement of continuously arriving yarn (3) such that it is placed into a yarn grasping device (14) of said empty bobbin (4);

f. axially retracting the traverse device (2) back to said winding zone (6) commencing of normal yarn laying or winding on said empty bobbin (4).

13. A method for yarn transfer during bobbin changeover operation in a device of claim 3 having an automatic turret type winder, said method comprising the steps of:

a. initiating yarn transfer operation in the device;

b. rotating the turret (8) of said winder and placing said empty bobbin (4) in said winding position;

c. placing traverse housing (13) in a position to allow yarn transfer;

d. axially shifting the traverse device (2) to extend the movement of traverse guide (7) beyond said winding zone (6) up to a yarn catchment area (16) of said empty bobbin;

e. allowing the movement of continuously arriving yarn (3) such that it is placed into a yarn grasping device (14) of said empty bobbin (4);

f. axially retracting the traverse device (2) back to said winding zone (6) commencing of normal yarn laying or winding on said empty bobbin (4).

14. A method for yarn transfer during bobbin changeover operation in a device of claim 4 having an automatic turret type winder, said method comprising the steps of:

a. initiating yarn transfer operation in the device;

b. rotating the turret (8) of said winder and placing said empty bobbin (4) in said winding position;

c. placing traverse housing (13) in a position to allow yarn transfer;

d. axially shifting the traverse device (2) to extend the movement of traverse guide (7) beyond said winding zone (6) up to a yarn catchment area (16) of said empty bobbin;

e. allowing the movement of continuously arriving yarn (3) such that it is placed into a yarn grasping device (14) of said empty bobbin (4);

f. axially retracting the traverse device (2) back to said winding zone (6) commencing of normal yarn laying or winding on said empty bobbin (4).

15. A method for yarn transfer during bobbin changeover operation in a device of claim 5 having an automatic turret type winder, said method comprising the steps of:

a. initiating yarn transfer operation in the device;

b. rotating the turret (8) of said winder and placing said empty bobbin (4) in said winding position;

c. placing traverse housing (13) in a position to allow yarn transfer;

d. axially shifting the traverse device (2) to extend the movement of traverse guide (7) beyond said winding zone (6) up to a yarn catchment area (16) of said empty bobbin;

e. allowing the movement of continuously arriving yarn (3) such that it is placed into a yarn grasping device (14) of said empty bobbin (4);

f. axially retracting the traverse device (2) back to said winding zone (6) commencing of normal yarn laying or winding on said empty bobbin (4).

16. A method for yarn transfer during bobbin changeover operation in a device of claim 6 having an automatic turret type winder, said method comprising the steps of:

a. initiating yarn transfer operation in the device;

b. rotating the turret (8) of said winder and placing said empty bobbin (4) in said winding position;

c. placing traverse housing (13) in a position to allow yarn transfer;

d. axially shifting the traverse device (2) to extend the movement of traverse guide (7) beyond said winding zone (6) up to a yarn catchment area (16) of said empty bobbin;

e. allowing the movement of continuously arriving yarn (3) such that it is placed into a yarn grasping device (14) of said empty bobbin (4);

f. axially retracting the traverse device (2) back to said winding zone (6) commencing of normal yarn laying or winding on said empty bobbin (4).

17. A method for yarn transfer during bobbin changeover operation in a device of claim 7 having an automatic turret type winder, said method comprising the steps of:

a. initiating yarn transfer operation in the device;

b. rotating the turret (8) of said winder and placing said empty bobbin (4) in said winding position;

c. placing traverse housing (13) in a position to allow yarn transfer;

d. axially shifting the traverse device (2) to extend the movement of traverse guide (7) beyond said winding zone (6) up to a yarn catchment area (16) of said empty bobbin;

e. allowing the movement of continuously arriving yarn (3) such that it is placed into a yarn grasping device (14) of said empty bobbin (4);

f. axially retracting the traverse device (2) back to said winding zone (6) commencing of normal yarn laying or winding on said empty bobbin (4).

18. A method for yarn transfer during bobbin changeover operation in a device of claim 8 having an automatic turret type winder, said method comprising the steps of:

a. initiating yarn transfer operation in the device;

b. rotating the turret (8) of said winder and placing said empty bobbin (4) in said winding position;

c. placing traverse housing (13) in a position to allow yarn transfer;

d. axially shifting the traverse device (2) to extend the movement of traverse guide (7) beyond said winding zone (6) up to a yarn catchment area (16) of said empty bobbin;

e. allowing the movement of continuously arriving yarn (3) such that it is placed into a yarn grasping device (14) of said empty bobbin (4);

f. axially retracting the traverse device (2) back to said winding zone (6) commencing of normal yarn laying or winding on said empty bobbin (4).

* * * * *